US009988254B2

(12) United States Patent
Cuddy et al.

(10) Patent No.: US 9,988,254 B2
(45) Date of Patent: Jun. 5, 2018

(54) FLUSH MOUNTABLE BOTTLE OPENERS

(71) Applicant: The Boeing Company, Chicago, IL (US)

(72) Inventors: Nathanial C. Cuddy, Snohomish, WA (US); Paul T. Bridgeman, Bothell, WA (US)

(73) Assignee: The Boeing Company, Chicago, IL (US)

( * ) Notice: Subject to any disclaimer, the term of this patent is extended or adjusted under 35 U.S.C. 154(b) by 179 days.

(21) Appl. No.: 14/799,620

(22) Filed: Jul. 15, 2015

(65) Prior Publication Data

US 2017/0015539 A1 Jan. 19, 2017

(51) Int. Cl.
*B67B 7/16* (2006.01)

(52) U.S. Cl.
CPC ..... *B67B 7/16* (2013.01); *B67B 7/162* (2013.01)

(58) Field of Classification Search
CPC ..... B67B 7/16; B67B 7/162
USPC ..... 81/3.25
See application file for complete search history.

(56) References Cited

U.S. PATENT DOCUMENTS 1,219,047 A * 3/1917 Schultz ..... B67B 7/16 81/3.27
1,463,139 A * 7/1923 Rush ..... B67B 7/16 81/3.27
2,565,775 A * 8/1951 Mendenhall ..... B67B 7/16 81/3.08
2,599,462 A * 6/1952 Kowarsch ..... B67B 7/16 81/3.08
2,677,980 A * 5/1954 Dika ..... B67B 7/16 81/3.27
6,752,040 B1 * 6/2004 Paul-Alexandre .... B67B 7/0423 81/3.09

* cited by examiner

*Primary Examiner* — Hadi Shakeri
(74) *Attorney, Agent, or Firm* — Kwan & Olynick LLP

(57) ABSTRACT

Provided are flush mountable bottle openers and methods of using such openers to remove bottle caps. These openers may be used in aircraft and other types of vehicles as well as any applications where protrusion away from supporting structures may be undesirable. A flush mountable bottle opener may include a base and a cap leverage plate pivotably coupled to the base. The base may protrude into a supporting structure such that the top edge of the base is substantially flush with the surface of the supporting structure. When the opener is not in use, the cap leverage plate may be closed and be substantially coplanar with the base edge. During operation, the cap leverage plate is brought into its open position directly by a user or using a bottle. The base and plate include engagement surfaces that support a bottle cap while the cap is removed.

21 Claims, 9 Drawing Sheets

FLUSH MOUNTABLE BOTTLE OPENERS

BACKGROUND

Conventional wall mountable bottle openers, which are used in aircrafts as well as other vehicles and environment, are difficult to clean because of various protrusions that require cavity access. When caps are removed from bottles some liquid may accidently spill into these cavities and needs to be cleaned. As a result, heavy sealing is often needed to minimize cleaning efforts and, in some cases (e.g., aircraft application), to meet FDA (Food and Drug Administration) requirements. The sealing may be unsightly and may deteriorate over time. Furthermore, conventional wall mountable bottle openers, significantly protrude beyond the wall surfaces. These openers may interfere with various operations performed in the surroundings and even cause safety concerns.

SUMMARY

Provided are flush mountable bottle openers and methods of using such openers to remove bottle caps. The provided openers may be used in aircraft and other types of vehicles as well as any applications where protruding away from supporting structures may be undesirable. A flush mountable bottle opener may include a base and a cap leverage plate pivotably coupled to the base. The base may recess into a supporting structure such that the top edge of the base is substantially flush with the surface of that supporting structure. When the opener is not in use, the cap leverage plate may be closed and be substantially parallel or even coplanar with the base edge. During operation, the cap leverage plate is moved into its open position directly by a user or indirectly, such as using a bottle to leverage the plate into the open position. The base and plate include engagement surfaces that support a bottle cap while the cap is removed from the bottle. Specifically, the bottle cap may be retained stationary by the base and plate engagement surfaces while the bottle is being pivoted by a user relative to the flush mountable bottle opener.

In some embodiments, a flush mountable bottle opener comprises a base and a cap leverage plate. The base comprises a recess and a base engaging surface disposed within the recess. In some embodiments, the recess of the base has a depth of less than 0.3 inches. This depth may be sufficient to accommodate other components of the opened when the cap leverage plate is closed. The cap leverage plate is pivotably coupled to the base. Specifically, the cap leverage plate is pivotable around the pivot axis between its closed and open positions. The cap leverage plate comprises plate engaging surface. As noted above, the base and plate engagement surfaces are used to support a bottle cap while the cap is removed from the bottle.

In some embodiments, the cap leverage plate at least partially extends into the recess of the base when the cap leverage plate is in the closed position. Furthermore, the cap leverage plate at least partially extends outside of the recess when in the open position. In the open position, the distance between the base and plate engagement surfaces is such that the bottle cap is supported by these surfaces. In some embodiments, the distance between the edges of the base and plate engagement surfaces is substantially the same or slightly smaller than the diameter of the bottle cap. Another part of the cap leverage plate (e.g., a top portion of the plate) may extend into the recess even when the plate is in the open position.

In some embodiments, the edge of the base engaging surface may be parallel to the edge of the plate engaging surface. In these embodiments, both the base and plate engagement surfaces may be planar. Furthermore, each of the edge of the base engaging surface and the edge of the plate engaging surface may be parallel to the pivot axis. The pivoting axis may be defined by the pivoting coupling between the base and plate. These parallel orientations of the edges (and the pivot axis) may be maintained for all positions of the cap leverage plate relative to the base. In other words, the edge of the base engaging surface may be parallel to the edge of the plate engaging surface when the plate is in the closed position and also when the plate is on the open position.

In some embodiments, the base engaging surface and the plate engaging surface may be parallel when the cap leverage plate is in the open position. However, the base engaging surface and the plate engaging surface may not be parallel when the cap leverage plate is in the closed position. In some embodiments, the pivot angle of the cap leverage plate between the closed position and the open position is between 20° and 40°. This may be also the angle at which the cap leverage plate is positioned relative to the surface of a supporting structure when the cap leverage plate is in the open position.

In some embodiments, the base comprises a lip surrounding the recess and extending away from the recess. The lip may extend over the surface of a supporting structure after installation of the flush mountable bottle opener. For example, the lip may be used to adhere or otherwise attach the flush mountable bottle to the supporting structure. The lip may also be used to seal the interface between the flush mountable bottle and supporting structure.

In some embodiments, the flush mountable bottle opener may include a rotation pin extending into base openings of the base. For example, the base may have two openings, one on each of the walls defining the depth of the base. The rotation pin may also extend into one or more plate openings of the cap leverage plate. The pin may provide the pivotable coupling of the cap leverage plate to the base. In some embodiments, the flush mountable bottle opener may include a biasing mechanism continuously forcing the cap leverage plate into the closed position. For example, the biasing mechanism may be a recoil spring. One end of the recoil spring may press on the cap leverage plate, while the other end may press on the base. In some embodiments, the rotation pin extends through the recoil spring as well.

In some embodiments, the front side of the cap leverage plate is substantially coplanar with the recess edge of the base when the cap leverage plate is in the closed position. The cap leverage plate may be positioned substantially within the recess when the cap leverage plate is in the closed position. Furthermore, the cap leverage plate may partially cover the recess when the cap leverage plate is in the closed position. The recess may be partially open when the cap leverage plate is in the closed position.

In some embodiments, the flush mountable bottle opener also has a positioning ball detent for retaining the cap leverage plate in each of the closed position and the open position. For example, the cap leverage plate may include a first recess and a second recess such that the first recess engages the positioning ball detent when the cap leverage plate is in the closed position and the second recess engages the positioning ball detent when the cap leverage plate is in the open position.

In some embodiments, the flush mountable bottle opener includes a dampener supported by the base. The dampener may contact the cap leverage plate when the cap leverage plate is in the closed position. In some embodiments, the tip of the cap leverage plate contacts the bottom recess surface of the recess when the cap leverage plate is in the open position. The tip of the cap leverage plate may be coplanar with the recess edge when the cap leverage plate is in the closed position.

Provided also is a method of removing the cap from the bottle using the flush mountable bottle opener. The method may involve engaging the plate engaging surface of the cap leverage plate with the bottle cap. The method may also involve engaging the base engaging surface with the bottle cap. Furthermore, the method may involve pivoting the bottle thereby removing the cap from the bottle. The bottle cap may be continuously supported by the plate engaging surface and the base engaging surface while the bottle is being pivoted.

In some embodiments, the method also involves pivoting the cap leverage plate relative to the base from the closed position into the open position. The cap leverage plate may be pivoted relative to the base (from the closed position into the open position) prior to engaging the plate engaging surface of the cap leverage plate with the cap of the bottle. Alternatively, the cap leverage plate may be pivoted relative to the base (from the closed position into the open position) after engaging the plate engaging surface of the cap leverage plate with the cap of the bottle. For example, pivoting the cap leverage plate relative to the base (from the closed position into the open position) may involve (a) inserting a top portion of the bottle comprising the cap into a recess of the base; (b) engaging the plate engaging surface with the cap of the bottle; and (c) pivoting the bottle while continuously engaging the plate engaging surface with the cap of the bottle. Pivoting the bottle pivots the cap leverage plate relative to the base from the closed position into the open position. In some embodiments, when the cap leverage plate reaches the open position, the cap of the bottle in in contact with the base engaging surface. While inserting the top portion of the bottle into the recess of the base below the cap leverage plate, a portion of the recess may be covered with the cap leverage plate.

In some embodiments, engaging the base engaging surface with the bottle cap involves sliding the bottle cap against the base while maintaining the plate engaging surface engaged with the bottle cap. The method may also involve, after removing the cap from the bottle, removing the bottle from the recess of the base. At this point, the cap leverage plate remains in its open position. Furthermore, after removing the bottle from the recess of the base and while the cap leverage plate remains in the open position, the method may proceed with (a) inserting a top portion of an additional bottle comprising an additional cap into the recess of the base, (b) engaging the plate engaging surface with the additional cap and engaging the base engaging surface with the additional cap, and (c) pivoting the additional bottle thereby removing the additional cap from the additional bottle.

In some embodiments, the method may involve, after removing the cap from the bottle, pivoting the cap leverage plate relative to the base from the open position and into the closed position. Pivoting the cap leverage plate into the closed position may involve applying an external force to the cap leverage plate to disengage a positioning boil detent of the flush mountable bottle opener.

These and other embodiments are described further below with reference to the figures.

DETAILED DESCRIPTION

Figure 1:
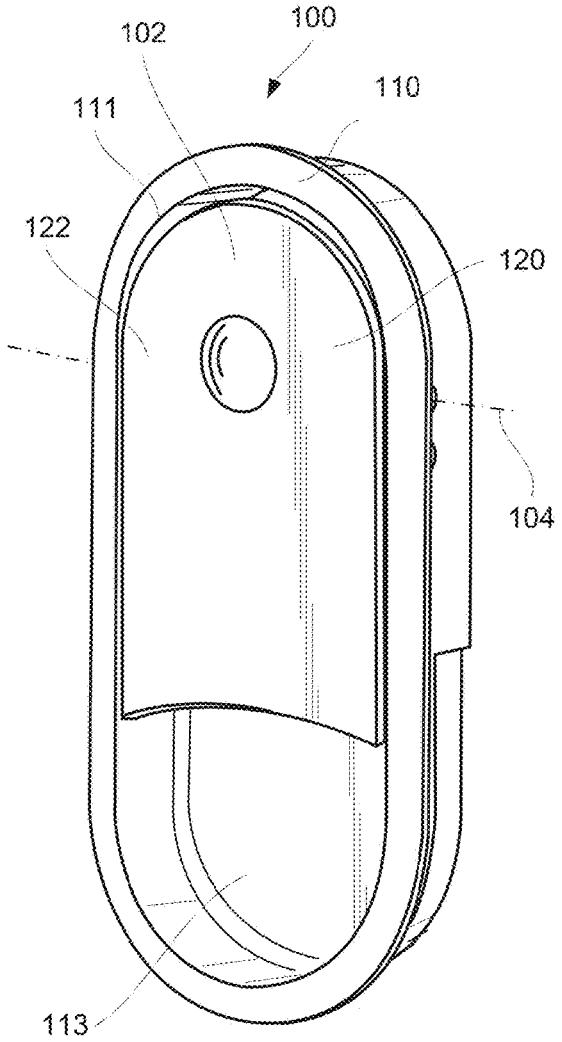
FIG. 1 is a schematic representation of a flush mountable bottle opener with its cap leverage plate in the closed position, in accordance with some embodiments.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

Introduction

Provided are flush mountable bottle openers and methods of using such openers to open bottles or, more specifically, to remove caps from the bottles. A flush mountable bottle opener is configured to nest substantially within a supporting structure (e.g., a wall). The flush mountable bottle opener may not protrude beyond the surface of the supporting structure or protrude insignificantly when the flush mountable bottle opener is not in use. For example, a conventional wall mounted bottle opener, currently used in many passenger aircraft, protrudes by at least about 1.50 inches from the supporting surface. With this level of protrusion, the conventional opener becomes a major obstacle and may even cause some safety concerns. A proposed flush mountable bottle opener may protrude by less than about 0.125 inches, such as the thickness of a lip of the flush mountable bottle opener extending over the supporting structure, e.g., when the flush mountable bottle opener is not in use. Even when the flush mountable bottle opener is in use, it may protrude less than the conventional opener because a portion of the flush mountable bottle opener extends below the surface of the supporting structure and therefore utilizes the space below the surface. In some embodiments, the flush mountable bottle opener protrudes by less than about 0.050-0.125 inches from the surface of the supporting structure.

The flush mountable bottle opener has a base and a cap leverage plate pivotably coupled to the base. The base may be mounted to any structure, such as a wall, capable of supporting the bottle opener and loads associated with operating the flush mountable bottle opener, such as pivoting the bottle while removing the bottle cap. More specifically, the base protrudes into the structure below the surface of the structure. In some embodiments, the base recesses into a supporting structure by between about 0.30 and 0.35 inches.

The cap leverage plate can pivot with respect to the base between the closed and open positions. The open position may be also referred to as an operating position. The cap leverage plate may be brought from the closed position to the open position by an operator (e.g., by pushing on the top portion of the cap leverage plate) or by inserting a bottle into an opening of the base below the cap leverage plate and using the bottle as a lever to move the cap leverage plate into the open position. While in the open position, the cap leverage plate may be retained in this position by a positioning ball detent, for example. Furthermore, when the detent is disengaged or not used and no external loads are applied to the cap leverage plate, the plate may be urged into the closed positioned by a biasing mechanism. Overall, the design of the flush mountable bottle opener allows for simple one handed bottle opening. Furthermore, the design provides for simple cleaning and does not need any additional sealing since the base may capture some spills and is easy to clean. Finally, the flush mountable bottle opener protrudes less than conventional bottle openers thereby creating less obstacles and providing safer operating environments. Flush mountable bottle openers may be used on aircraft, other vehicles, and any environment with limited space (e.g., a walkway in a bar or a restaurant) or, for example, where flush mount is desired for any reasons.

Examples of Flush Mountable Bottle Openers

FIG. 1 is a schematic representation of flush mountable bottle opener 100, in accordance with some embodiments. In some embodiments, flush mountable bottle opener 100 comprises base 110 and cap leverage plate 120. Base 100 has recess 113 that contains other components of flush mountable bottle opener 100. In some embodiments base 100 has a depth of less than 0.3 inches or, more specifically, less than 0.25 inches. It should be noted that even with such a small depth, flush mountable bottle opener 100 is operable to engage the standard size bottle caps because of its pivotable nature of cap leverage plate 120. Cap leverage plate 120 protrudes into recess 113 as various stages of operations of flush mountable bottle opener 100 as further described below. Base 110 also has base engaging surface 114 disposed within recess 113 as, for example, more clearly illustrates shown in FIGS. 2 and 3A. Base engaging surface 114 engages bottle cap 304 during its removal from bottle 302 as further described below and shown in FIGS. 7B and 7C. More specifically, base engaging surface 114 supports bottle cap 304 when bottle 302 is pivoted 105 relative to flush mountable bottle opener 100 during the actual removal of bottle cap 304.

Figure 7A:
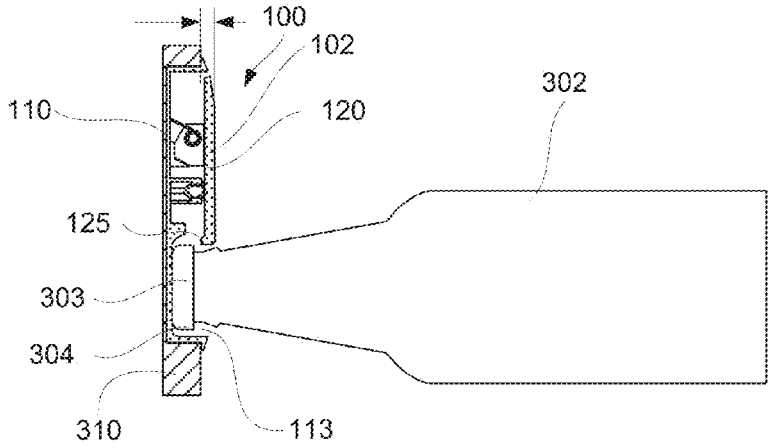
FIGS. 7A-7E are schematic representations of the bottle and the flush mountable bottle opener shown in FIG. 1 during various stages of removal the cap from the bottle, in accordance with some embodiments.
Figure 7B:
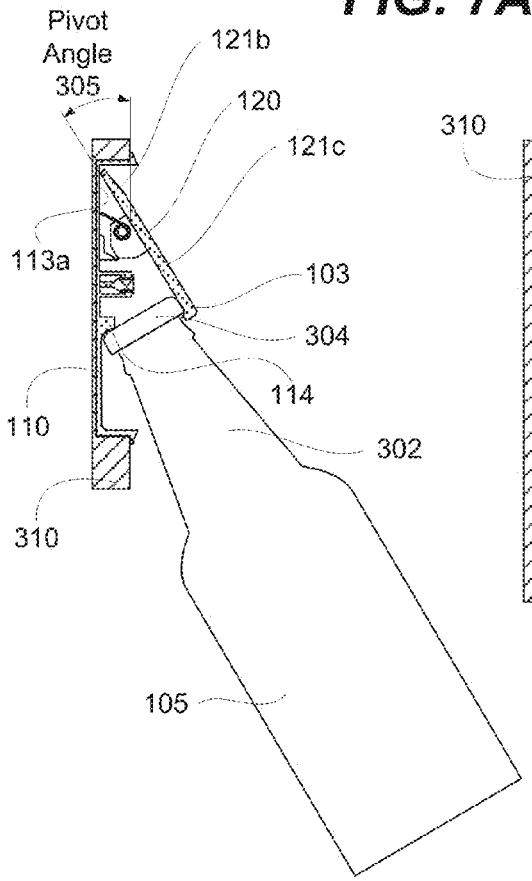
Figure 7C:
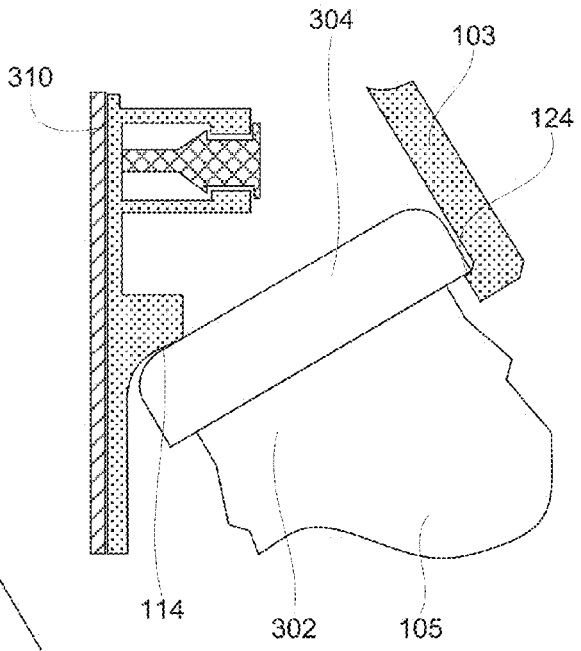

Cap leverage plate 120 is pivotably coupled to base 110. Specifically, cap leverage plate 120 is pivotable around pivot axis 104 between it's closed position 102 and open position 103 with respect to base 110. FIGS. 1 and 7A are schematic representation of flush mountable bottle opener 100 with cap leverage plate 120 in closed position 102. FIGS. 7B and 7C are schematic representations of flush mountable bottle opener 100 with cap leverage plate 120 in open position 103. Pivot angle 305 may be between about 20° and 30°.

Figure 4A:
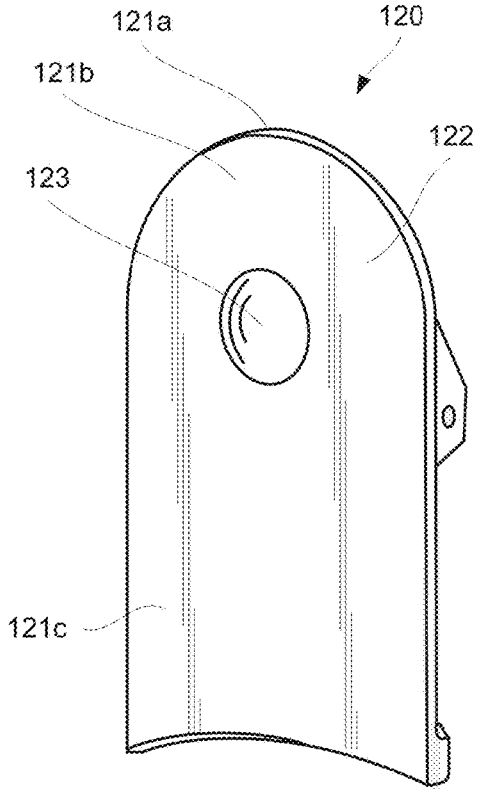
FIGS. 4A and 4B are two schematic representations of a cap leverage plate of the flush mountable bottle opener shown in FIG. 1, in accordance with some embodiments.
Figure 4B:
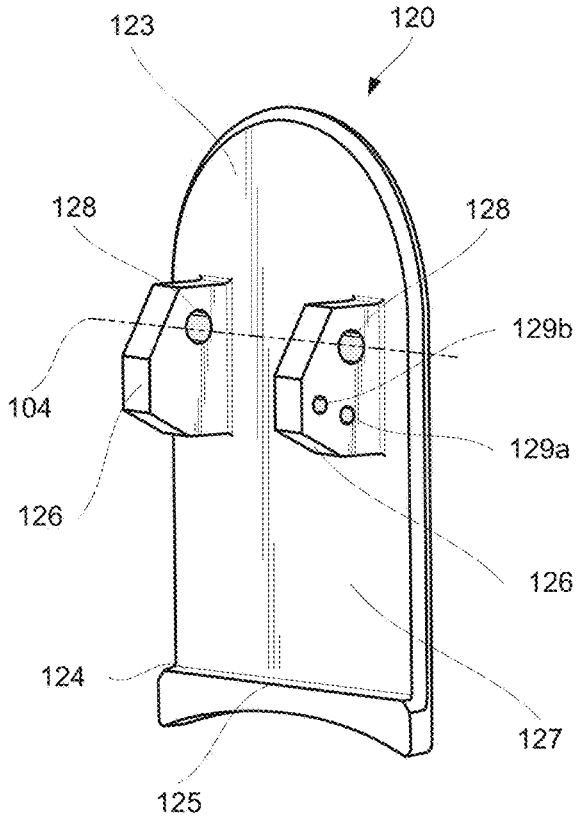
Figure 4C:
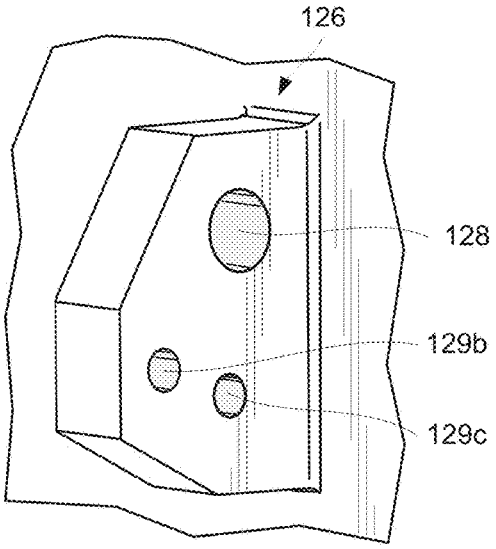
FIG. 4C is a schematic expanded representation of a plate arm of the cap leverage plate shown in FIGS. 4A and 4B, in accordance with some embodiments.

As shown in FIG. 4B, cap leverage plate 120 comprises plate engaging surface 124. Plate engaging surface 124 engages bottle cap 304 during removal of bottle cap 304 from bottle 302 as further described below and shown in FIGS. 7B and 7C. Specifically, FIGS. 7B and 7C illustrate a processing stage immediately prior to the removal of bottle cap 304 from bottle 302. Any further pivoting of bottle 302 will cause the removal of bottle cap 304 from bottle 302 since bottle cap 304 remains stationary and is retained by flush mountable bottle opener 100. More specifically, plate engaging surface 124 supports bottle cap 304 when bottle 302 is pivoted relative to flush mountable bottle opener 100 during the removal of bottle cap 304. Plate engaging surface 124 may also continuously engage bottle cap 304 when bottle 302 is used to pivot 105 cap leverage plate 120 into its open position 103 as further described below.

In some embodiments, cap leverage plate 120 at least partially extends into recess 113 of base 110 when cap leverage plate 120 is in closed position 102 as can be seen from FIG. 1 and, more clearly, from FIG. 7A. Cap leverage plate 120 may or may not extend outside of cavity 113 of base 110 when cap leverage plate 120 is in closed position 102. If cap leverage plate 120 extends outside of cavity 113 as schematically shown in FIG. 7A, the amount of this extension may be less than 0.125 inches or even less than 0.0625 inches. For example, front side 122 of cap leverage plate 120 may bow above the plane formed by edge 111 of base 110. In some embodiments, at least the edge of front side 122 of cap leverage plate 120 may be coplanar with edge 111 of base 110 when cap leverage plate 120 is closed position 102.

Cap leverage plate 120 at least partially extends outside of recess 113 when in open position 103 as, for example, shown in FIGS. 7B and 7C. For example, bottom portion 121*c* of cap leverage plate 120 containing plate engaging surface 124 may extend outside of recess 113. This provides adequate distance between plate engaging surface 124 and base engaging surface 114 to accommodate and support the bottle cap.

In some embodiments, another part of cap leverage plate 120 (e.g., top portion 121*b*) may extend into recess 113 even when cap leverage plate 120 is in open position 103. Specifically, top portion 121*b* (e.g., tip 121*a*) of cap leverage plate 120 may contact bottom recess surface 113*a* when cap leverage plate 120 is in open position 103 as, for example, shown in FIG. 7B. In this example, bottom recess surface 113*a* operates as a positive stop for cap leverage plate 120 and prevents cap leverage plate 120 from further pivoting, such as when bottle cap 304 is removed from bottle 302 and when the force is applied to cap leverage plate 120 by bottle 302. Tip 121*a* of cap leverage plate 120 may be coplanar with edge 111 of recess 113 of base 110 when cap leverage plate 120 is in closed position 102 as, for example, shown in FIG. 1.

Figure 3A:
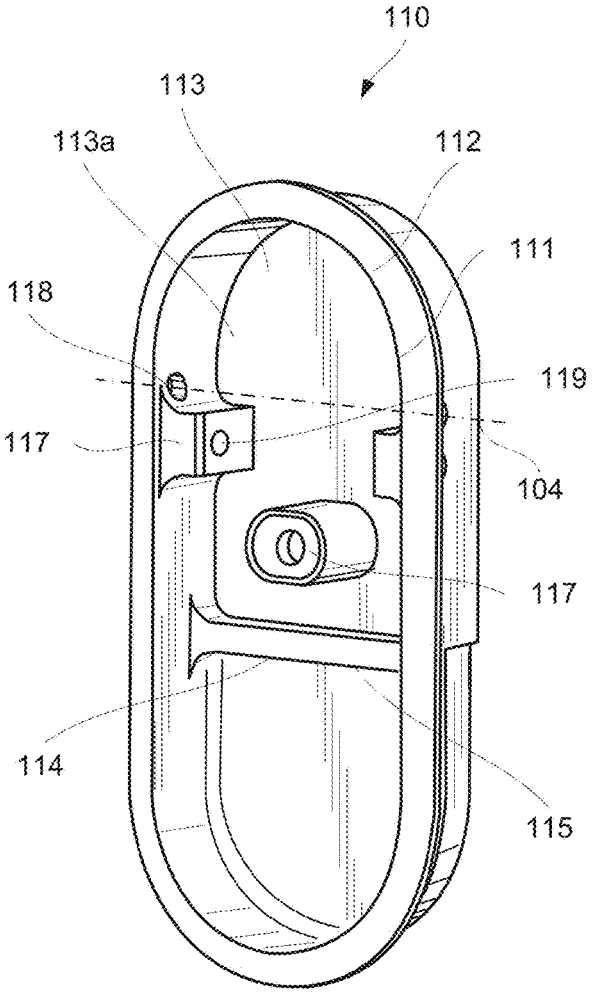
FIGS. 3A and 3B are two schematic representations of a base of the flush mountable bottle opener shown in FIG. 1, in accordance with some embodiments.

Base engaging surface 114 may be characterized by edge 115 as, for example, shown in FIG. 3A. Edge 115 is a feature of base engaging surface 114 closest to cap leverage plate 120. Plate engaging surface 124 may be characterized by edge 125, which is a feature of plate engaging surface 124 closest to base 110. In some embodiments, edge 115 of base engaging surface 114 is parallel to edge 125 of plate engaging surface 124. Furthermore, each of edge 115 of base engaging surface 114 and edge 125 of plate engaging surface 124 may be parallel to pivot axis 104 as shown in FIGS. 3A and 4B. These parallel orientations may be maintained for all positions (e.g., closed position 102 and open position 103) of cap leverage plate 120 relative to base as, for example, shown in FIGS. 7A and 7B. Furthermore, base engaging surface 114 and plate engaging surface 124 may be parallel when cap leverage plate 120 is in open position 103 as, for example, shown in FIG. 7C. In some embodiments, base engaging surface 114 and plate engaging surface 124 may not be parallel when cap leverage plate 120 is in closed position 102. In some embodiments, the pivot angle of cap leverage plate 120 between closed position 102 and open position 103 is between 20° and 40° as, for example, shown in FIG. 7B.

Figure 3B:
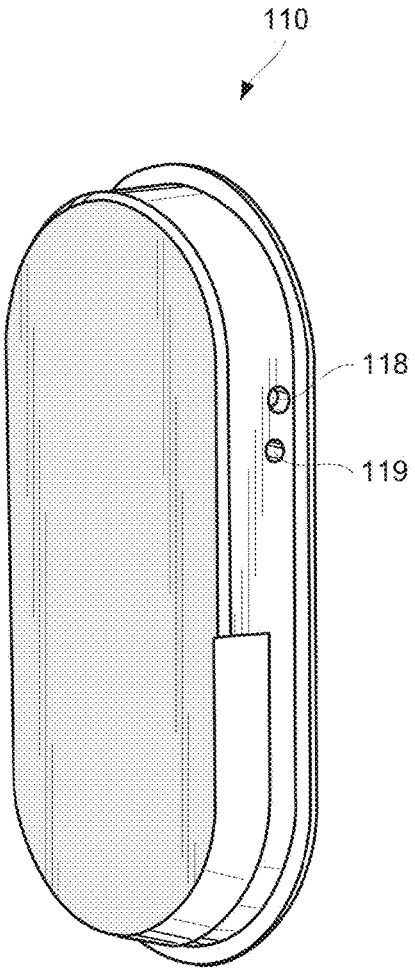

In some embodiments, base 110 comprises lip 112 as, for example, shown in FIG. 3B surrounding recess 113 and extending away from recess 113 or, more specifically, from edge 111 of recess. Lip 112 may extend over the surface of supporting structure 310 after installation of flush mountable bottle opener 100 as, for example, shown in FIGS. 7A and 7C.

Figure 2:
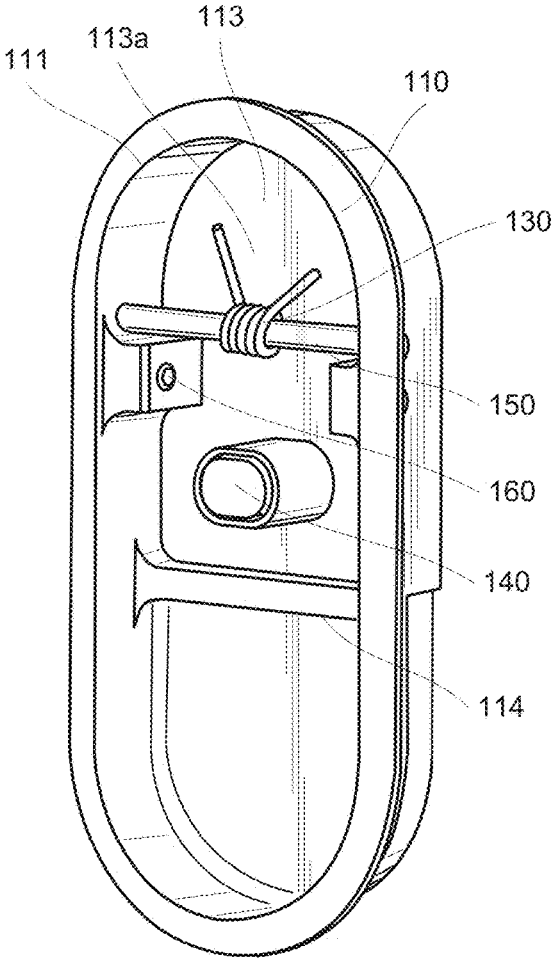
FIG. 2 is a schematic representation of the flush mountable bottle opener shown in FIG. 1 with its cap leverage plate removed to illustrate various internal components of the bottle opener, in accordance with some embodiments.

In some embodiments, flush mountable bottle opener 100 includes rotation pin 150 extending into base openings 118 of base 110 as, for example, shown in FIG. 2. For example, base 110 may have two base openings 118 on the opposite sides of the walls defining recess 113 in the direction of the recess depth. Rotation pin 150 may also extend into one or more openings 128 of cap leverage plate 120. For example, FIG. 4B illustrates two plate arms 126 extending from back side 127 of cap leverage plate 120. Each of plate arms 126 has opening 128 for receiving rotation pin 150. Rotation pin 150 provides pivotable coupling between cap leverage plate 120 and base 110.

In some embodiments, flush mountable bottle opener 100 includes biasing mechanism 130, which may continuously force cap leverage plate 120 into closed position 102. For example, biasing mechanism 130 may be a recoil spring. In some embodiments, rotation pin 150 extends through the recoil spring. One end of the recoil spring may contact base 110 or, more specifically, bottom recess surface 113*a* of base 110. The other end of the recoil spring may contact cap leverage plate 120. While opening cap leverage plate 120, the force of biasing mechanism 130 applied between base 110 and cap leverage plate 120 is exceeded by the operator, which forces cap leverage plate 120 into open position 103.

In some embodiments, front side 122 of cap leverage plate 120 is substantially coplanar with edge 111 of recess 113 of base 110 when cap leverage plate 120 is in closed position 102 as, for example, shown in FIGS. 1 and 7A. Cap leverage plate 120 may be positioned substantially within recess 113 of base 110 when cap leverage plate 120 is in closed position 102. Furthermore, cap leverage plate 120 may partially cover recess 113 of base 110 when cap leverage plate 120 is in closed position 102 as, for example, shown in FIG. 1. In the same example, recess 113 of base 110 may be partially open when cap leverage plate 120 is in closed position 102 as, for example, also shown in FIG. 1. As such, top portion 303 of bottle 302 having cap 304 may be inserted into recess 113 of base 110 even when cap leverage plate 120 is in closed position 102. This feature may be used to move cap leverage plate 120 into open position 103 using bottle 302 as further described below with reference to FIGS. 7A-7B.

In some embodiments, flush mountable bottle opener 100 also includes positioning ball detent 160 for retaining cap leverage plate 120 in at least one of closed position 102 and open position 103. More specifically, positioning ball detent 160 may retain cap leverage plate 120 in each of closed position 102 and open position 103. Positioning ball detent 160 may be supported by base 110. Specifically, base 110 may include one or more detent openings 119 as, for example, shown in FIG. 3A, which shows two arms 117 extending with recess 113 of base 110 each containing different detent opening 119. Other configurations for supporting one or more positioning ball detents 160 are also within the scope.

Figure 5:
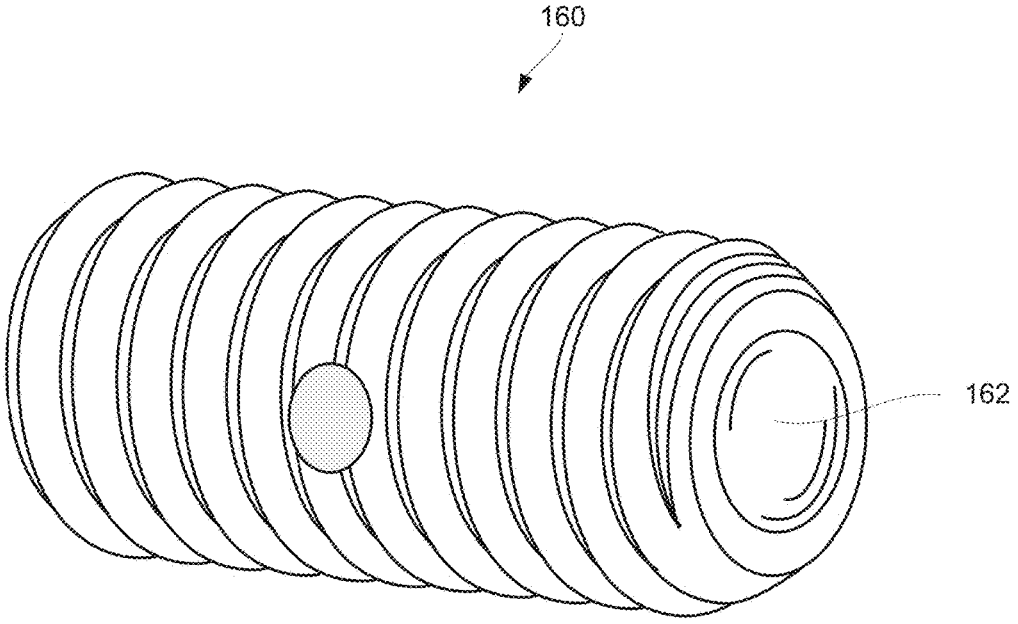
FIG. 5 is a schematic representation of a positioning ball detent of the flush mountable bottle opener shown in FIG. 1, in accordance with some embodiments.
Figure 7D:
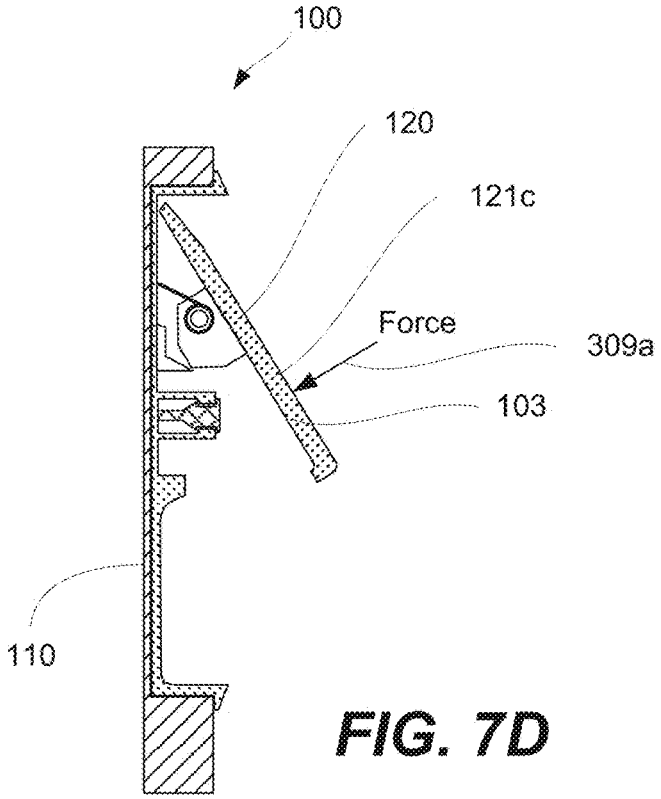
Figure 7E:
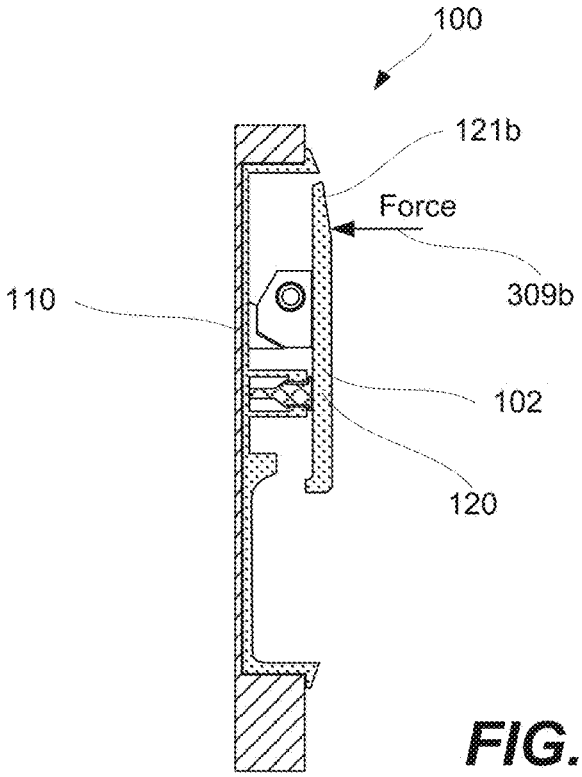

Positioning ball detent 160 may include, for example, spring loaded surface 162 (e.g., a half-sphere surface as shown in FIG. 5) for engaging another component, such as first recess 129 and second recess 129*b* of cap leverage plate 120. Specifically, positioning ball detent 160 engages one of first recess 129 and second recess 129*b* at a time depending on the position of cap leverage plate 120. First recess 129*a* may engage positioning ball detent 160 when cap leverage plate 120 is in closed position 102, while second recess 129*b* may engage positioning ball detent 160 when cap leverage plate 120 is in open position 103. In some embodiments, when positioning ball detent 160 engages one of first recess 129*a* and second recess 129*b*, cap leverage plate 120 remains in the corresponding position until external force 309*a* is applied to cap leverage plate 120 as, for example, shown in FIG. 7D. For example, cap leverage plate 120 may remain in open position 103 even though biasing mechanism 130 may force cap leverage plate 120 into closed position 102 at that time. In other words, without external force 309*a*, biasing mechanism 130 alone may not be able to disengage positioning ball detent 160 from second recess 129*b* and start advancing cap leverage plate 120 toward closed position 102. However, as soon as positioning ball detent 160 is disengaged from second recess 129*b*, biasing mechanism 130 may further advance cap leverage plate 120 into closed position 102 as, for example, shown in FIG. 7E.

In some embodiments, flush mountable bottle opener 100 includes dampener 140 for absorbing the impact by cap leverage plate 120 as cap leverage plate 120 reaches closed position 102. Damper 140 effectively prevents cap leverage plate 120 from hitting base 110 as cap leverage plate 120 reaches closed position 102. Damper 140 may be supported by base 110. Alternatively, damper 140 may be disposed on cap leverage plate 120. Damper 140 may be made from a flexible (e.g., impact absorbing such as elastomeric) material, such as rubber. Dampener 140 may contact cap leverage plate 120 and base 110 when cap leverage plate 120 is in closed position 102. Dampener 140 may not contact either cap leverage plate 120 or base 110 when cap leverage plate 120 is in open position 103.

Examples of Removing Bottle Caps Using Flush Mountable Bottle Openers

Figure 6:
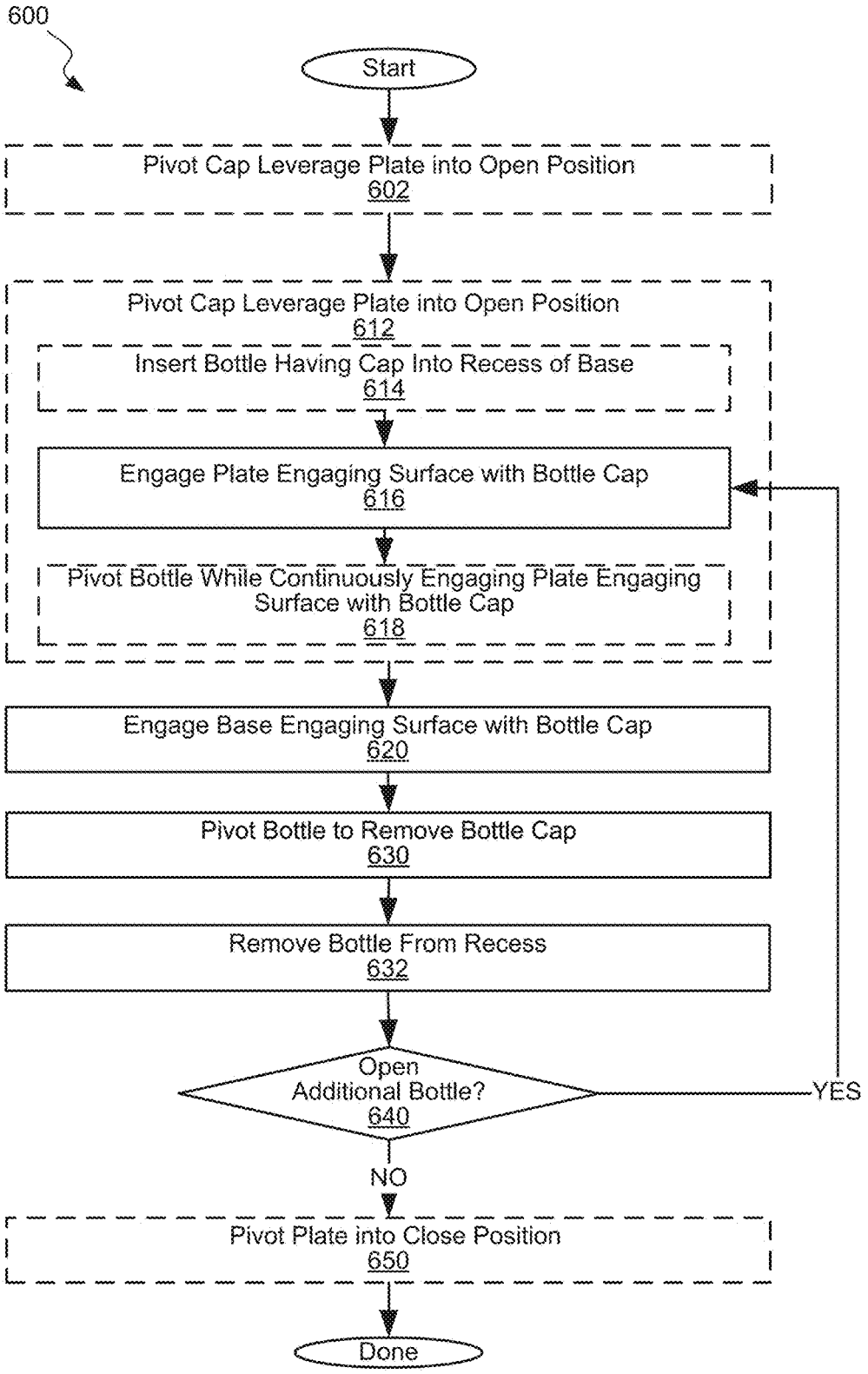
FIG. 6 is a process flowchart corresponding to a method of using the flush mountable bottle opener shown in FIG. 1 to remove a cap from a bottle, in accordance with some embodiments.

FIG. 6 is a process flowchart corresponding to method 600 of using flush mountable bottle opener 100 to remove bottle cap 304, in accordance with some embodiments. Various examples of flush mountable bottle opener 100 are described above with reference to FIGS. 1-5. Furthermore, various stages of method 200 are illustrated in FIGS. 7A-7E and described below.

In some embodiments, method 600 involves pivoting cap leverage plate 120 relative to base 110 from closed position 102 into open position 103 of cap leverage plate 120 during optional operation 602. For example, an operator may exert force 309*b* on top portion 121*b* of cap leverage plate 120 (as, for example, shown in FIG. 7E). Force 309*b* advances top portion 121*b* into recess 113 of base 110. Because cap leverage plate 120 is supported with respect to base 110 along pivot axis 104, force 309*b* also advances bottom portion 121*c* away from base 110 and outside of recess 113 of base 110 (as, for example, shown in FIG. 7D). As described above, bottom portion 121*c* includes plate engaging surface 124.

It should be noted that cap leverage plate 120 may be pivoted relative to base 110 from closed position 102 into open position 103 during operation 602 (described above) or during operation 612 (described below). Operation 602 may be performed by an operator and prior to engaging plate engaging surface 124 of cap leverage plate 120 with bottle cap 304 during operation 616. As noted above, operation 602 may involve exerting force 309*b* on top portion 121*b* of cap leverage plate 120 as, for example, shown in FIG. 7E. This force causes cap leverage plate 120 to advance from its closed position 102 (shown in FIG. 7E) and into open position 103 (shown in FIG. 7D).

Alternatively, cap leverage plate 120 may be pivoted relative to base 110 from closed position 102 into open position 103 during operation 612 as schematically shown by FIGS. 7A and 7B. Specifically, cap leverage plate 120 may be pivoted while pivoting bottle 302 during operation 618. Operation 618 is performed after engaging plate engaging surface 124 of cap leverage plate 120 with cap 304 of bottle 302 during operation 616. In other words, operation 612 is a combined operation that causes cap leverage plate 120 to pivot from closed position 102 into open position 103.

Other operations may be also included into combined operation 612. Specifically, operation 612 may involve inserting top portion 330 of bottle 302 comprising cap 304 into recess 113 of base 110 during operation 614 and, for example, as schematically shown in FIG. 7A. The portion of recess 113 receiving bottle 302 during operation 614 is not covered by cap leverage plate 120. The remaining portion of recess 113 may be covered with cap leverage plate 120 during this operation.

Operation 612 may then involve engaging plate engaging surface 124 with bottle cap 304 during operation 616. For example, the operator may orient bottle 302 in such a way that engagement occurs. Finally, operation 612 may involve pivoting bottle 302 while maintaining the contact between plate engaging surface 124 with bottle cap 304 as, for example, schematically shown by the transition from FIG. 7A to FIG. 7B. Pivoting bottle 302 may also pivot cap leverage plate 120 relative to base 110 from closed position 102 into open position 103. In some embodiments, when cap leverage plate 120 reaches open position 103 (either during operation 602 or during operation 612), bottle cap 304 is in contact with base engaging surface 114 of base 110.

In some embodiments, optional operation 602 or operation 612 is not performed and method 600 may start with cap leverage plate 120 being already in open position 103. For example, flush mountable bottle opener 100 may have been used previously to open another bottle. It should be noted that operation 616 may be performed without completing other parts of operation 612. In other words, operation 616 may be performed without performing operation 616. For example, operation 616 when cap leverage plate 120 is already in open position 103.

Method 600 may involve engaging plate engaging surface 124 with bottle cap 304 during operation 616. This operation may be performed as a part of operation 612 (e.g., pivoting cap leverage plate 120 into open position 103) or as a separate operation. For example, cap leverage plate 120 may be already in open position 103 prior to operation 616. Cap leverage plate 120 may be moved into open position 103 by an operator during operation 602 or while opening another bottle (e.g., operation 612 performed using another bottle after which cap leverage plate 120 remains in open position 103). As described above, once cap leverage plate 120 is in open position 103, cap leverage plate 120 may be retained in this open position 103 by positioning ball detent 160.

Method 600 may also involve engaging base engaging surface 114 with bottle cap 304 during operation 620. This operation may be performed after operation 616, e.g., when operation 616 is a part of operation 612 and when cap leverage plate 120 moves into open position 103 by the pivoting bottle 302. Alternatively, when cap leverage plate 120 is in open position 103 already, operation 620 may be performed prior to operation 616. In some embodiments, engaging base engaging surface 114 with bottle cap 304 during operation 620 involves sliding bottle cap 304 against base 110 while maintaining plate engaging surface 124 of cap leverage plate 120 engaged with bottle cap 304.

Method 600 may involve pivoting bottle 302 thereby removing bottle cap 304 from bottle 302 during operation 630. During this operation, bottle cap 304 engages base engaging surface 114 and plate engaging surface 124. These surfaces 114 and 124 support bottle cap 304 and, in some embodiments, keep bottle cap 304 stationary while bottle 302 is being pivoted with respect to flush mountable bottle opener 100.

Method 600 may also involve removing bottle 302 from recess 113 of base 110 during operation 632. Cap leverage plate 120 may remain in open position 103 after removing bottle 302 from recess 113. Furthermore, method 600 may proceed with opening another bottle as shown by decision block 640. In this case, method 600 may proceed with inserting a top portion of an additional bottle comprising an additional cap into recess 113 of base 110. Method 600 may then proceed with engaging plate engaging surface 124 with the additional cap and engaging base engaging surface 114 with the additional cap. Furthermore, method 600 may proceed with pivoting the additional bottle thereby removing the additional cap from the additional bottle.

In some embodiments, method 600 may involve pivoting cap leverage plate 120 relative to base 110 from open position 103 and into closed position 102 during operation 650. Pivoting cap leverage plate 120 relative to base 110 from open position 103 and into closed position 102 may involve applying an external force to cap leverage plate 120 to disengage positioning boil detent 160 of flush mountable bottle opener 100.

Examples of Aircraft and Methods of Fabricating and Operation Aircraft

Figure 8:
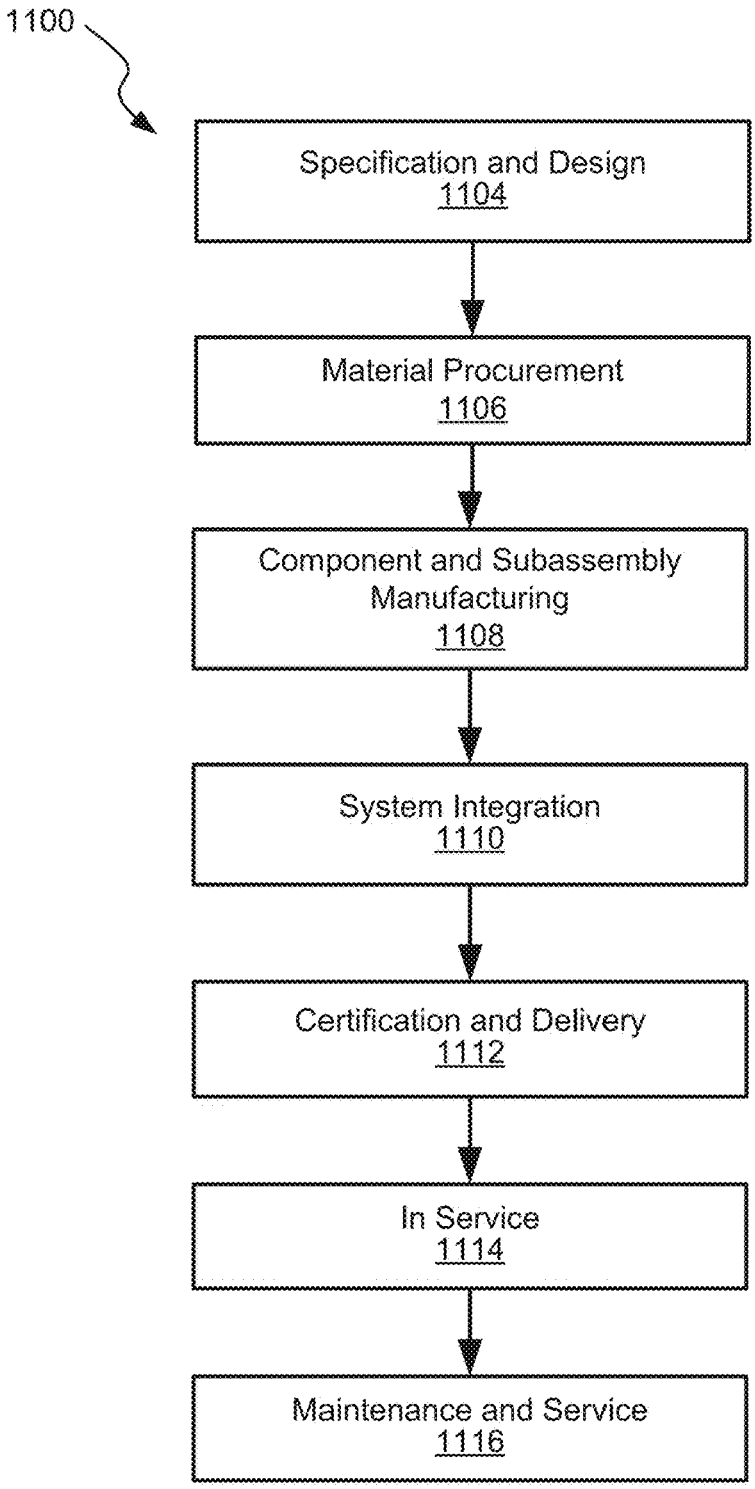
FIG. 8 is a block diagram of aircraft production and service methodology.
Figure 9:
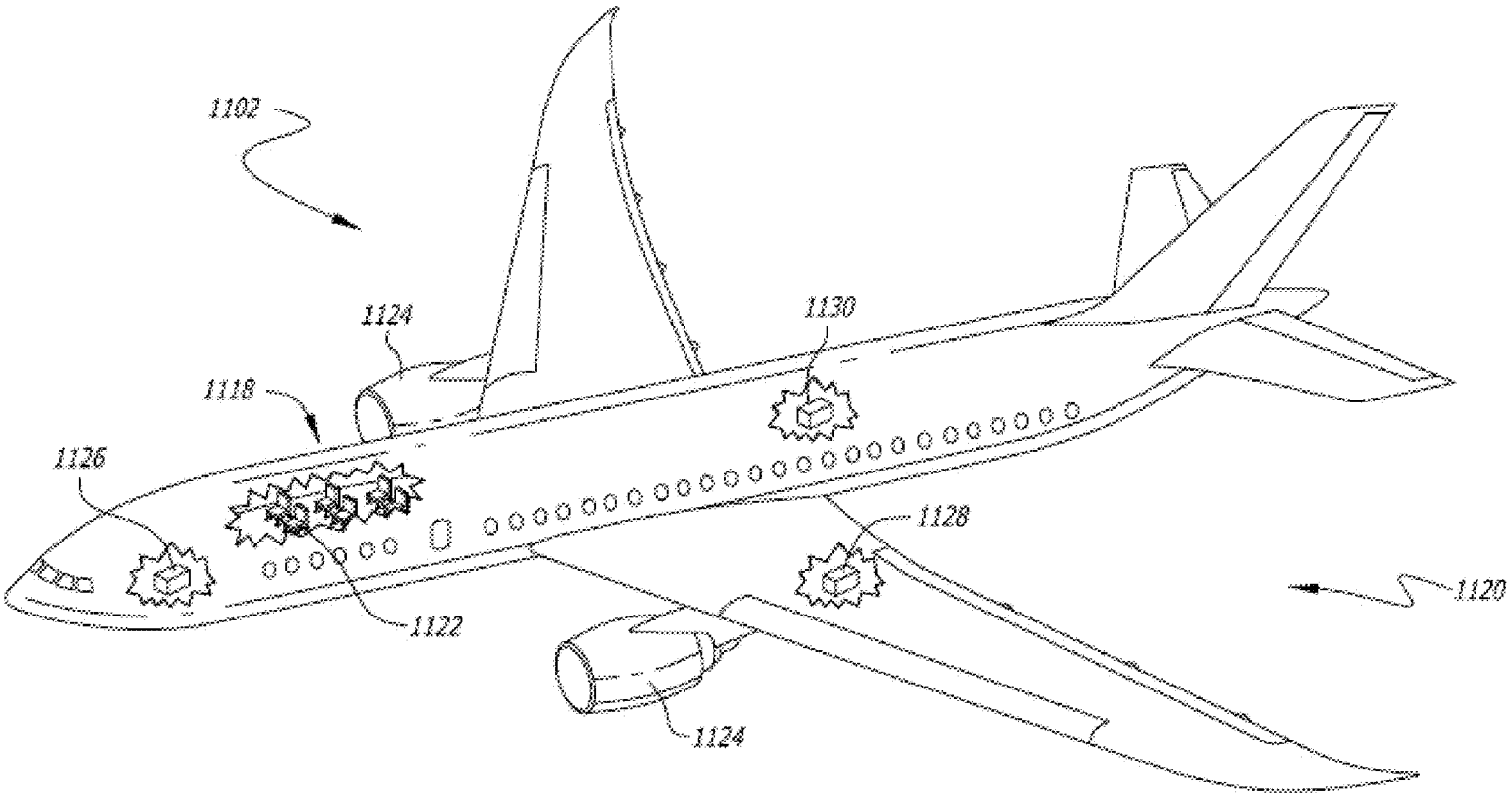
FIG. 9 is a schematic illustration of an aircraft.

Examples of the present disclosure may be described in the context of aircraft manufacturing and service method 1100 as shown in FIG. 8 and aircraft 1102 as shown in FIG. 9. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. One or more flush mountable bottle openers may installed on aircraft 1102 during one of these operations. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102. The one or more flush mountable bottle openers installed on aircraft 1102 may be used during its service (block 1114).

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 9, aircraft 1102 produced by illustrative method 1100 may include airframe 1118 with a plurality of high-level systems 1120 and interior 1122, which may include the one or more flush mountable bottle openers. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Conclusion

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A flush mountable bottle opener comprising a base comprising:

a recess and a base engaging surface;

a positioning ball detent supported by the base; and a cap leverage plate pivotably coupled to the base and pivotable around a pivot axis between a closed position and an open position, the cap leverage plate comprising a plate engaging surface, a first recess, and a second recess, the first recess engaging the positioning ball detent when the cap leverage plate is in the closed position, the second recess engaging the positioning ball detent when the cap leverage plate is in the open position.

2. The flush mountable bottle opener of claim 1, wherein the base engaging surface is disposed within the recess.

3. The flush mountable bottle opener of claim 1, wherein the cap leverage plate at least partially extends into the recess of the base when the cap leverage plate is in the closed position, and wherein the cap leverage plate at least partially extends outside of the recess when in the open position.

4. The flush mountable bottle opener of claim 1, wherein an edge of the base engaging surface and an edge of the plate engaging surface are parallel.

5. The flush mountable bottle opener of claim 1, wherein the base engaging surface and the plate engaging surface are parallel when the cap leverage plate is in the open position.

6. The flush mountable bottle opener of claim 1, wherein the base comprises a lip surrounding the recess and extending away from the recess.

7. The flush mountable bottle opener of claim 1, further comprising a rotation pin extending into base openings of the base and extending into plate openings of the cap leverage plate and providing pivotable coupling of the cap leverage plate to the base.

8. The flush mountable bottle opener of claim 1, further comprising a biasing mechanism continuously forcing the cap leverage plate into the closed position.

9. The flush mountable bottle opener of claim 8, wherein the biasing mechanism is a recoil spring.

10. The flush mountable bottle opener of claim 9, further comprising a rotation pin extending info base openings of the base and extending into plate openings of the cap leverage plate and providing pivotable coupling of the cap leverage plate to the base, wherein the rotation pin extends through the recoil spring.

11. The flush mountable bottle opener of claim 10, wherein a first end of the recoil spring contacts the base, and wherein a second end of the recoil spring contacts the cap leverage plate.

12. The flush mountable bottle opener of claim 1, wherein a front side of the cap leverage plate is substantially coplanar with an edge of the recess of the base when the cap leverage plate is in the closed position.

13. The flush mountable bottle opener of claim 1, wherein the cap leverage plate is positioned substantially within the recess of the base when the cap leverage plate is in the closed position.

14. The flush mountable bottle opener of claim 1, wherein the cap leverage plate partially covers the recess of the base when the cap leverage plate is in the closed position, and wherein the recess of the base is partially open when the cap leverage plate is in the closed position.

15. The flush mountable bottle opener of claim 1, further comprising a dampener supported by the base, wherein the dampener contacts the cap leverage plate when the cap leverage plate is in the closed position.

16. The flush mountable bottle opener of claim 15, wherein the dampener is separated from the cap leverage plate when the cap leverage plate is in the open position.

17. The flush mountable bottle opener of claim 15, wherein the dampener comprises an impact absorbing material.

18. The flush mountable bottle opener of claim 1, wherein the positioning ball detent comprises a spring-loaded surface for engaging the first recess engaging or the second recess engaging.

19. The flush mountable bottle opener of claim 1, wherein the first recess engaging the positioning ball detent retains the cap leverage plate in the closed position, and wherein the second recess engaging the positioning ball detent retains the cap leverage plate in the open position.

20. The flush mountable bottle opener of claim 1, wherein a pivot angle of the cap leverage plate between the closed position and the open position is between 20° and 40°.

21. The flush mountable bottle opener of claim 1, wherein a tip of the cap leverage plate contacts a bottom recess surface of the recess when the cap leverage plate is in the open position.

* * * * *